US005967447A

United States Patent [19]

Hinz et al.

[11] Patent Number: 5,967,447

[45] Date of Patent: Oct. 19, 1999

[54] CONTINUOUSLY OPERATING REEL CUTTER WITH A WINDING SECTION

[75] Inventors: Joachim Hinz, Kempen; Herbert Müller, Krefeld, both of Germany

[73] Assignee: Voith Sulzer Finishing GmbH, Krefeld, Germany

[21] Appl. No.: 09/175,730

[22] Filed: Oct. 20, 1998

[30] Foreign Application Priority Data

Nov. 3, 1997 [DE] Germany ..... 197 48 648

[51] Int. Cl.[6] ..... B65H 18/08

[52] U.S. Cl. ..... 242/530.4; 242/530; 242/531; 242/531.1; 242/548

[58] Field of Search ..... 242/530.4, 525, 242/530, 533, 542, 548, 531, 531.1

[56] References Cited

U.S. PATENT DOCUMENTS

| | | | |
|---|---|---|---|
| 344,187 | 6/1886 | Manning | 242/530 |
| 618,287 | 1/1899 | Patterson | 242/530 X |
| 1,013,490 | 1/1912 | Hellberg | 242/530.4 |
| 1,059,503 | 4/1913 | Stuart | 242/530.4 X |
| 3,127,123 | 3/1964 | Bowker et al. | 242/530.4 X |
| 3,304,023 | 2/1967 | O'Brien | 242/531 X |
| 3,591,101 | 7/1971 | Gallet et al. | 242/525 X |
| 3,779,475 | 12/1973 | Plevin | 242/530.4 |
| 3,944,152 | 3/1976 | Heymanns | 242/530.4 |
| 4,050,972 | 9/1977 | Cardinal, Jr. | 156/530.4 X |
| 4,186,893 | 2/1980 | Kolosov et al. | 242/530.4 |
| 4,342,432 | 8/1982 | Lund et al. | 242/530.4 |
| 4,346,852 | 8/1982 | Kawada et al. | 242/530.4 |
| 4,458,853 | 7/1984 | Heymanns | 242/530 |
| 4,621,777 | 11/1986 | O'Connor | 242/525 X |
| 5,062,582 | 11/1991 | Harmon et al. | 242/530.4 X |
| 5,842,663 | 12/1998 | O'Connor et al. | 242/530.4 |

FOREIGN PATENT DOCUMENTS

| | | | |
|---|---|---|---|
| 2750639 | 11/1978 | Germany | 242/530 |
| 3040189 | 5/1981 | Germany . | |
| 2165525 | 9/1981 | Germany . | |
| 353020065 | 2/1978 | Japan | 242/530.4 |

*Primary Examiner*—Donald P. Walsh
*Assistant Examiner*—Minh-Chau Pham
*Attorney, Agent, or Firm*—Greenblum & Bernstein, P.L.C.

[57] ABSTRACT

Reel cutter and method for a substantially continuously winding-on of partial web rolls. The reel cutter may include a cutting section adapted for cutting a material web into a plurality of partial webs and a winding section adapted for winding the plurality of partial webs onto partial web rolls. The partial web rolls may be arranged such that neighboring partial web rolls are located in winding position groups positionally offset from one another. The winding section may include at least one additional and no more than twice the number of winding position groups necessary for winding-on of the partial web rolls. The method may include positionally offsetting at least a first and second winding position groups such that each winding position group includes a plurality of winding positions that are axially spaced apart, positionally offsetting at least a third winding position group, alternatingly guiding neighboring partial webs to the first and second winding position groups, and winding the partial webs into partial web rolls. The method may also include preparing the third winding position group to include winding positions that correspond to the first winding group, completing the winding on of the partial web rolls of the first winding group, and transferring the partial webs from the first winding group to the third winding group.

14 Claims, 1 Drawing Sheet

CONTINUOUSLY OPERATING REEL CUTTER WITH A WINDING SECTION

CROSS-REFERENCE TO RELATED APPLICATIONS

The present application claims priority under 35 U.S.C. § 119 of German Patent Application No. 197 48 648.7, filed on Nov. 3, 1997, the disclosure of which is expressly incorporated by reference herein in its entirety.

BACKGROUND OF THE INVENTION

1. Field of the Invention

The present invention relates to a reel cutter having a cutting section for cutting a material web into a plurality of partial webs and a winding section for winding the partial webs into partial web rolls. The partial web rolls are arranged such that neighboring partial web rolls are located in winding position groups that are positionally offset from one another. The present invention also relates to a method for a substantially continuously winding-on of partial web rolls.

2. Discussion of Background Information

In one of the last manufacturing steps, the web, e.g., a paper web, is cut to widths that can be used by a subsequent processor, e.g., a printer. Since paper webs can easily have widths in a range between 8 and 10 m, and the widths desired by consumers are generally within range between 0.8 m and 3.8 m, a plurality of partial webs within the desired width range are cut from one paper web. These partial webs are then wound onto partial web rolls. If it is necessary to keep the end faces of the partial web rolls freely accessible during winding, e.g., for the supporting arms of a roll core support, then the winding positions must be arranged to be offset from one another, i.e., laterally to the winding axis. As a result, the individual partial web rolls can be located axially spaced apart from one another. All of the winding positions in which partial web rolls are positioned axially spaced apart constitute a winding position group, and the partial web rolls of different winding position groups are located within the interstices of one another, i.e., within the axial gap between adjacent partial web rolls in a winding position group.

Certain preparations must be made for a winding-on of the partial web rolls, e.g., a prepared roll core is generally inserted into the winding position. In the set-up times required for this, winding cannot take place. Thus, the winding of partial web rolls must be interrupted for each set-up. As a result, the effectiveness of the reel cutter is impaired because the pauses that are inserted between the individual winding procedures become distinctly noticeable.

SUMMARY OF THE INVENTION

The present invention provides a reel cutter that does not suffer from the above-noted drawbacks of the prior art and provides a reel cutter with increased effectiveness.

In this regard, the present invention provides a reel cutter, similar in general to the one discussed above, and that includes no more than twice as many winding position groups as are necessary for winding-on of the partial web rolls.

In accordance with the present invention, "winding-on" may be understood as the process in which partial web rolls are rotated to establish or form the partial web rolls. Transitions from one partial web roll to another or, more precisely, to a new roll core or roll center, do not produce winding-on in this sense. Because more winding position groups are provided than are required in and of themselves, the free winding position group(s) may be utilized so that the necessary preparations for a subsequent winding-on of the partial web rolls, e.g., insertion of prepared roll cores into the individual winding position(s), may be made. In the simplest instance, twice as many winding position groups may be provided so that for each winding position, there is a substitute position to which the partial web can be transferred during the roll change. As a result, a quasi-continuous winding can be realized. Moreover, the setup times are, at least to a large extent, eliminated.

In an exemplary embodiment of the present invention, at least one winding position group more, but less than twice the winding position groups required for the winding-on of the partial web rolls, may be provided in the winding section. Moreover, each partial web may be guided via a web conveyor to each winding position group. The present invention may also include a control device that continues to wind at least one partial web roll while at least one roll change takes place. In this embodiment, at least one winding position group may be saved because fewer than twice the winding position groups required for winding-on of the partial web rolls are provided. It may generally be sufficient if only one additional winding position group is provided. While this arrangement may not allow one substitute position to be reserved for each winding position, such an arrangement is not necessary if each partial web can be guided to each winding position group and if the change or transfer from a full partial web roll to a new partial web roll occurs while the other partial web rolls continue to be wound. Accordingly, not all of the partial web rolls are ready to be changed at the same time. In this manner, it is not necessary to change all of the partial webs at the same time. A procedure of this kind may be provided without problems whenever the material web can be continuously supplied. In lieu of a continuous supply, the material web having a length that is greater than the length of the material web to be wound onto individual partial web rolls may be supplied, e.g., supplying the material web by unwinding so-called jumbo rolls.

In a preferred exemplary embodiment, three winding position groups may be utilized, which is, e.g., a minimal equipment. Winding then takes place so that partial web rolls are wound in winding position groups designated as winding position groups I and II. Winding position group III may remain free and be utilized for preparing the roll cores for subsequent winding. If, e.g., the partial web rolls in winding position II are finished, a transfer of the partial webs to the roll cores in winding position III can be carried out and, as a result, winding position II is left free to be prepared for a subsequent transfer of the partial webs from winding position I. Once the partial web rolls in winding position group III are finished, they may be transferred to winding position group I, which was left free after transferring the partial webs to winding position II. In this manner, it is possible to secure individual partial web rolls in winding position groups that are spaced axially apart from one another. Moreover, one winding position group always remains free so that the necessary preparations for winding-on can take place. Accordingly, interruption of the operation is practically unnecessary or, at most, is only necessary for a very short time to ensure the transfer individual partial webs from one winding position group to another.

It may be advantageous to arrange the winding position groups so that all the winding position groups are accessible from at least one side. This facilitates, e.g., the preparation of the roll cores or performing other measures for subsequent winding. That is, from the accessible side the roll cores may be inserted or the other measures may be taken without the operator being hindered by the winding position groups.

In a particular embodiment, the accessibility of the winding position groups is provided arranging the winding position groups one above the other so that the winding position groups are accessible from a vertical side.

In an alternative embodiment, the winding position groups may be arranged spaced one behind the other. Further, bridges may be positioned between the winding position groups and a web travel path for the partial webs may pass under the bridges. In this manner, the responsible operator may stand on the bridge to prepare the free winding position group without being disturbed by the partial web.

Moreover, devices may be provided for changing or transferring the partial webs between individual winding position groups on the fly. In this instance, it may not even be necessary to stop the reel cutter during the transfer of partial webs from one winding position group to the other. The devices for changing the partial webs on the fly are generally known to those in the art, and they are generally composed of a cutting device that cuts the partial web and a capturing and conveying device that brings the free ends of the partial webs to the new winding position group.

In the exemplary embodiment, the winding position groups may be formed as support roll winders. As such, it may be necessary to keep the end faces freely accessible because the roll cores may have to be secured.

The present invention is directed to a reel cutter that includes a cutting section adapted for cutting a material web into a plurality of partial webs and a winding section adapted for winding the plurality of partial webs onto partial web rolls. The partial web rolls may be arranged such that neighboring partial web rolls are located in winding position groups positionally offset from one another. The winding section may include at least one additional and no more than twice the number of winding position groups necessary for a winding-on of the partial web rolls.

In accordance with another feature of the present invention, the winding section may further include web conveying devices adapted to guide each of the plurality of partial webs to each winding position group. The reel cutter may further include a control device adapted to continuously wind at least one partial web roll while at least one roll change takes place.

In accordance with another feature of the present invention, the winding section may include three winding position groups.

In accordance with still another feature of the present invention, all of the winding position groups may be arranged to be accessible from at least one side.

In accordance with a further feature of the present invention, the winding position groups may be arranged one above the other.

In accordance with still another feature of the present invention, the winding position groups may be arranged spaced apart one behind the other. The reel cutter may further include bridges located between the winding position groups. A web travel path for the plurality of partial webs may pass under the bridges.

In accordance with a still further feature of the present invention, transferring devices adapted for transferring the partial webs between individual winding position groups on the fly may be provided.

In accordance with another feature of the present invention, the winding position groups may include support roll winders.

The present invention is also be directed to a method for a substantially continuously winding-on of partial web rolls. The method may include positionally offsetting at least a first and second winding position groups such that each winding position group includes a plurality of winding positions that are axially spaced apart, positionally offsetting at least a third winding position group, alternatingly guiding neighboring partial webs to the first and second winding position groups, and winding the partial webs into partial web rolls. The method may also include preparing the third winding position group to include winding positions that correspond to the first winding group, completing the winding on of the partial web rolls of the first winding group, and transferring the partial webs from the first winding group to the third winding group. Further, the transferring of the partial web may be performed while the second winding position group continues winding.

In accordance with another feature of the present invention, the method further includes preparing the first winding position group to include winding positions that correspond to the first winding group, completing the winding-on of the partial web rolls of the second winding group, and transferring the partial webs from the second winding group to the first winding group. Further, the transferring of the partial web may be performed while the third winding position group continues winding-on.

In accordance with yet another feature of the present invention, the method further includes preparing the second winding position group to include winding positions that correspond to the third winding group, completing the winding-on of the partial web rolls of the third winding group, and transferring the partial webs from the third winding group to the second winding group. Further, the transferring of the partial web may be performed while the first winding position group continues winding.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention may be utilized for forming and winding partial web rolls from a material web. While the exemplary description of the present invention discusses a paper web, the present invention should not be construed as limited to this or any other particular web material. Accordingly, the features of the present invention may be practiced with any material web known to those ordinarily skilled in the art.

Figure 1A:
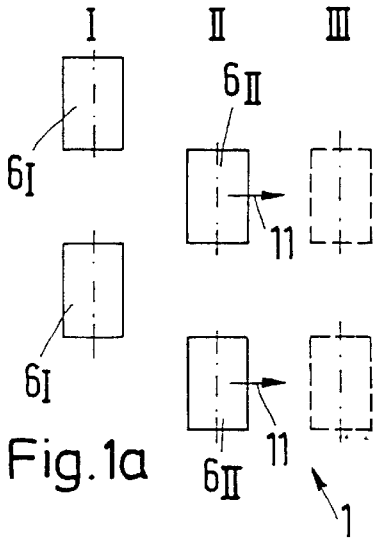
FIGS. 1*a*, 1*b*, and 1*c* schematically illustrate the process of the present invention for winding partial web rolls.
Figure 1B:
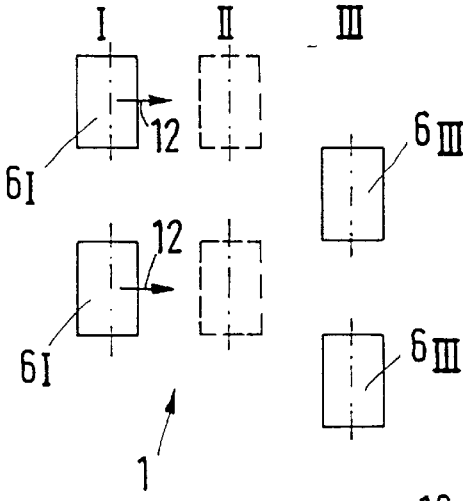
Figure 1C:
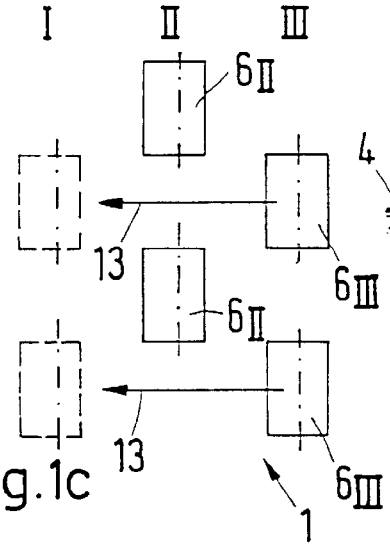
Figure 2:
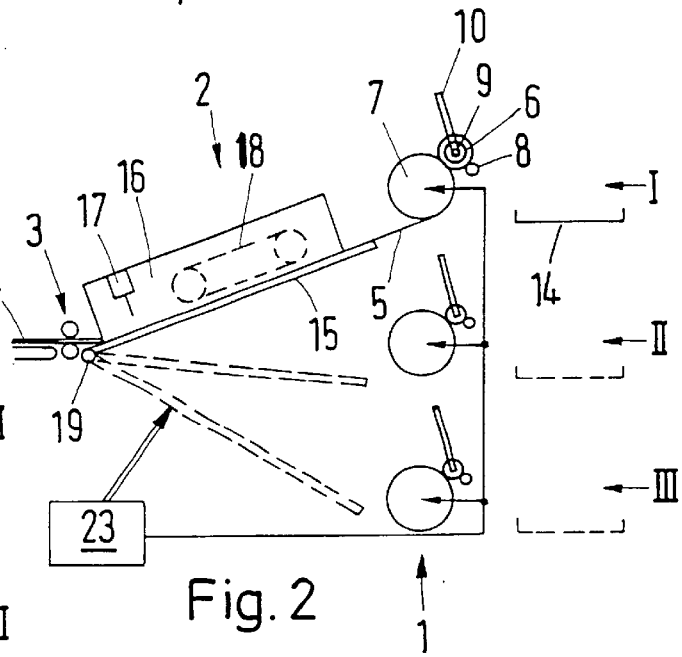
FIG. 2 schematically illustrates a side view of a reel cutter in accordance with the present invention.

FIGS. 1*a*–1*c* and 2 schematically illustrate a winding section 1 of a reel cutter 2. Before winding section 1, reel cutter 2 includes a cutting station 3, through which a material web 4 is guided and cut into a plurality of partial webs 5. The plurality of partial webs 5 may be wound onto partial web rolls 6. As illustrated in FIG. 2, for the sake of explanation and clarity, only an individual partial web 5 is shown, and partial web roll 6 is illustrated in an initial stage of winding.

Partial web roll 6 in the initial stage of winding may be positioned to rest against a first support roll 7, which may have a large diameter, e.g., compared to a roll core 9 of partial web roll 6, and against a second support roll 8, which may have a small diameter, e.g., compared to roll core 9 of partial web roll 6. Roll core 9 of partial web roll 6 may be held or supported by laterally arranged supporting arms 10, and a driver for roll core 9 may be provided on at least one of thc supporting arms 10. Driving of roll core 9 may also, or alternatively, be provided by rotationally driving at least one of support rolls 7 and 8.

FIGS 1*a*–1*c* schematically depict winding section 1 and partial web rolls, i.e., without support rolls 7 and 8 or supporting arms 10. Further, for the sake of clarity and explanation, the course of partial webs 5 are not depicted in these figures.

As shown in FIG. 1*a*, partial web rolls (shown in solid lines) may be located in two winding position groups, e.g., winding position groups I and II, which may be offset from each another. Moreover, the partial web rolls in winding position group I may be located in the interstices (or axial gaps between) the partial web rolls in winding position group II. The partial web rolls in winding position group I are designated as $\mathbf{6}_I$ and the partial web rolls in winding position group II are designated as $\mathbf{6}_{II}$. As shown, each partial web roll is positioned in a winding position, and a plurality of winding positions, e.g., axially spaced, form a winding position group.

Further, at least a third winding position group III, which is in addition to the winding position groups I and II that are necessary for the winding-on of the partial web rolls, is provided. Winding position group III, during the winding of partial web rolls $\mathbf{6}_I$ and $\mathbf{6}_{II}$, is left free, i.e., no winding occurs. For example, the winding positions in which partial web rolls $\mathbf{6}_{III}$ will be subsequently wound is depicted in dashed lines. Further, in the positions shown in dashed lines, an empty roll core 9 may be inserted or the winding position may be prepared in some other way prior to the winding-on of a partial web roll. In this arrangement, e.g., once partial web rolls $\mathbf{6}_{II}$ have finished winding, the partial webs corresponding to the winding position of partial web rolls $\mathbf{6}_{II}$, and, therefore, to the positions prepared for winding partial web rolls $\mathbf{6}_{III}$, may be transferred to the prepared winding positions in winding position group III, as indicated by arrows 11. The concurrent winding of partial web rolls $\mathbf{6}_I$ and $\mathbf{6}_{III}$ is schematically depicted in FIG. 1*b*. During the concurrent winding of partial web rolls $\mathbf{6}_I$ and $\mathbf{6}_{III}$, winding position group II may be empty (or free) and, thus, may be prepared for winding new partial web rolls, as represented with dashed lines.

When partial web rolls $\mathbf{6}_I$ in winding position group I are finished winding, the partial webs corresponding to the winding positions of partial web rolls $\mathbf{6}_I$, and, therefore, to the positions prepared for winding partial web rolls $\mathbf{6}_{II}$, may be transferred to the prepared winding positions in winding position group II, as indicated by arrows 12. After this transfer, winding position group I may be empty.

FIG. 1*c* schematically illustrates the winding-on of partial web rolls $\mathbf{6}_{II}$ and $\mathbf{6}_{III}$ in winding position groups II and III, respectively. This winding-on process continues until partial web rolls $\mathbf{6}_{III}$ are completely wound, i.e., until they have reached their desired diameter. Since the winding-on of partial web rolls $\mathbf{6}_{II}$ began after the winding of partial web rolls $\mathbf{6}_{III}$ had begun, partially web roll $\mathbf{6}_{II}$ have not as of yet attained their final diameter. Thus, the winding of partial web rolls $\mathbf{6}_{II}$ continues while the partial webs corresponding to the winding positions of partial web $\mathbf{6}_{III}$, and therefore, the positions prepared for winding partial web rolls $\mathbf{6}_I$, may be transferred to the prepared winding positions in winding position group I, as indicated by arrows 13.

To perform the process of the present invention, web conveying devices 15 may be positioned and utilized to guide partial webs 5 into the appropriate winding position group I, 11, and III. Further, it may be advantageous to provide and utilize a control device 23 to facilitate continuous winding. In this manner, individual winding position groups I–III may be controlled independently of each other. For example, a winding position group may be continuously wound while the transfer of the partial webs 5 from winding position group with completed partial web rolls to the winding position group prepared for winding-on occurs.

Normally, when a plurality of partial web rolls located in different winding position groups are wound offset from one another, i.e., each in the interstices of the other, two winding position groups are required. With the procedure according to the present invention, twice the number of winding position groups may not be necessary to prepare the winding-on of a new partial web roll group during the winding-on of a partial web roll group. Instead, only one additional winding position group may be necessary. In the case of two winding position groups, this may also be one winding position group less than twice the winding position groups necessary for winding-on of the partial web rolls.

Figure 3:
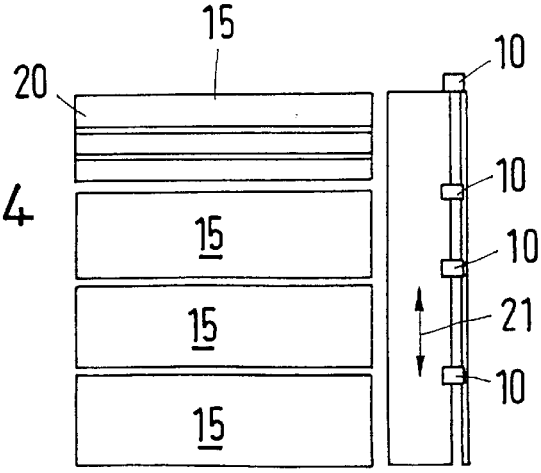
FIG. 3 schematically illustrates a top view of the reel cutter in accordance with the present invention.

FIGS. 2 and 3 schematic depict an exemplary embodiment of the present invention. In FIG. 2, a schematic side view of reel cutter 2 is depicted, which also depicts winding position groups I–III arranged one above the other. On the right-hand side of the drawing, a lifting platform 14, which can assume different positions (as shown in dashed lines), may be provided, so that an operator can reach each winding position group I–III. In this manner, at least one side of the winding position groups is freely accessible to operators or other personnel. Moreover, the completed partial web rolls may be removed on lifting platform 14.

A guide rail, on which a web cutting and guiding device 16 may be located, may be used as a conveying device 15.

Web cutting and guiding device 16 may include a cutting blade 17 and a driving belt 18 so that when cutting blade 17 cuts partial web 5, driving belt 18 may engage the newly-formed beginning of partial web 5 and supply it to a corresponding winding position within one of winding position groups I–III.

Conveying device 15 may be pivotable around a pivoting point 19 and controlled by control device 23. In this manner, partial web 5 may reach or be supplied to each of the three winding position groups I–III, which is represented with dashed lines.

As depicted in exemplary FIG. 3, for four possible positions of partial web rolls 6 in the winding position group I (which is the only winding position group visible from above in this exemplary embodiment), four conveying devices 15 may be provided. Conveying devices 15 may be pivoted independently of one another so that partial webs 5 can be supplied to their respective winding position groups I–III. For example, the first and third conveying devices 15, i.e., from the top, may be positioned to load winding position group I, while the second and the fourth conveying devices 15, i.e., from the top, may be positioned to load winding position group III. However, when fundamentally considered, conveying devices 15 may only be necessary at the beginning of the winding. After the partial web 5 has been loaded, conveying device 15 may be pivoted into, e.g., a rest position.

If a finer resolution is necessary, conveying device 15 may be divided into a plurality of strips 20 that can be pivoted independently of one another and, if necessary, can be driven.

Supporting arms 10 can be adjustable in a direction depicted by double arrow 21 so that partial web rolls 6 in the winding positions of winding position group I can be wound. The set-up or preparation for winding of a new partial web roll may include axially shifting supporting arms 10 to a distance to accommodate, e.g., roll core 9. This adjustability may be utilized in all winding position groups.

Web cutting and guiding device 16 is only schematically represented. While additional parts, e.g., for conveying partial web 5 around support roll 7 and, if necessary, to fasten partial web 5 to roll core 9, are not particularly shown in the drawings, these parts, and their operation in system of this type, are generally known to those skilled in the art.

Figure 4:
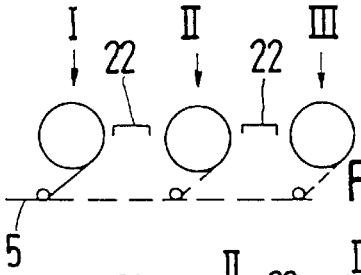
FIG. 4 illustrates an alternative embodiment of the reel cutter of the present invention.

FIG. 4 illustrates an alternative embodiment of the present invention in which winding position groups I–III are arranged one behind the other. For reasons of clarity, other details have been omitted. Between the individual winding position groups I–III, bridges 22 may be located so that an operator may walk and may prepare corresponding winding position groups I–III. Partial webs 5 may be conveyed beneath bridges 22.

Figure 5:
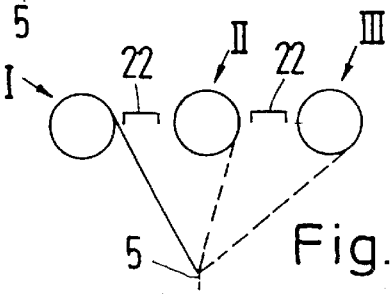
FIG. 5 illustrates another alternative embodiment of the reel cutter of the present invention.

FIG. 5 illustrates another alternative arrangement for winding position groups I–III. In this arrangement, winding position groups I–III are positioned next to one another, i.e., partial webs 5 are supplied from underneath. In this arrangement, bridges 22 may be provided between the individual winding position groups I–III in order to permit an operator or other personnel access to the winding position groups.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A reel cutter comprising:

cutting section adapted for cutting a material web into a plurality of partial webs;

winding section adapted for winding the plurality of partial webs onto partial web rolls and the partial web rolls being arranged such that neighboring partial web rolls arc located in winding position groups positionally offset from one another; and the winding section including at least one additional and less than twice the number of winding position groups necessary for winding-on of the plurality of partial web rolls.

2. The reel cutter according to claim 1, further including web conveying devices adapted to guide each of the plurality of partial webs to each winding position group; and further comprising a control device adapted to continuously wind at least one partial web roll while at least one roll change takes place.

3. The reel cutter according to claim 1, the winding section including three winding position groups.

4. The reel cutter according to claim 3, all of the winding position groups being arranged to be accessible from at least one side.

5. The reel cutter according to claim 4, the winding position groups being arranged one above the other.

6. The reel cutter according to claim 4, the winding position groups being arranged spaced apart one behind the other;

further comprising bridges being located between the winding position groups, wherein a web travel path for the plurality of partial webs passes under the bridges.

7. The reel cutter according to claim 1, further comprising:

devices for transferring the partial webs between individual winding position groups on the fly.

8. The reel cutter according to claim 1, the winding position groups comprising support roll winders.

9. A method for a substantially continuously winding-on of partial web rolls comprising:

positionally offsetting at least a first and second winding position groups, wherein each winding position group includes a plurality of winding positions that are axially spaced apart;

positionally offsetting at least a third winding position group;

alternatingly guiding neighboring partial webs to the first and second winding position groups;

winding the partial webs into partial web rolls;

preparing the third winding position group to include winding positions that correspond to the first winding group;

completing the winding on of the partial web rolls of the first winding group;

transferring the partial webs from the first winding group to the third winding group.

10. The method in accordance with claim 9, wherein the transferring of the partial web is performed while the second winding position group continues winding.

11. The method in accordance with claim 9, further comprising:

preparing the first winding position group to include winding positions that correspond to the first winding group;

completing the winding-on of the partial web rolls of the second winding group;

transferring the partial webs from the second winding group to the first winding group.

12. The method in accordance with claim 1, wherein the transferring of the partial web is performed while the third winding position group continues winding-on.

13. The method in accordance with claim 11, further comprising:

preparing the second winding position group to include winding positions that correspond to the third winding group;

completing the winding-on of the partial web rolls of the third winding group;

transferring the partial webs from the third winding group to the second winding group.

14. The method in accordance with claim 13, wherein the transferring of the partial web is performed while the first winding position group continues winding.

* * * * *